United States Patent [19]

Shikama et al.

[11] Patent Number: 4,954,692

[45] Date of Patent: Sep. 4, 1990

[54] POSITIVE TEMPERATURE COEFFICIENT THERMISTOR DEVICE FOR A HEATING APPARATUS

[75] Inventors: Takashi Shikama; Asami Wakabayashi, both of Yokaichi; Kiyofumi Torii, Ohmihachiman, all of Japan

[73] Assignee: Murata Manufacturing Co., Ltd., Japan

[21] Appl. No.: 242,966

[22] Filed: Sep. 9, 1988

[30] Foreign Application Priority Data

Sep. 11, 1987 [JP] Japan ..... 62-229161

[51] Int. Cl.[5] ..... H05B 3/04

[52] U.S. Cl. ..... 219/365; 219/505; 219/530; 219/544

[58] Field of Search ..... 219/365, 366, 372, 375, 219/376, 504, 505, 530, 538, 540, 542, 544; 361/392, 394, 395

[56] References Cited

U.S. PATENT DOCUMENTS

| | | | |
|---|---|---|---|
| 4,147,927 | 4/1979 | Pirotte | 219/505 |
| 4,327,282 | 4/1982 | Nauerth | 219/539 |
| 4,346,285 | 8/1982 | Nakamura et al. | 219/505 |
| 4,426,573 | 1/1984 | Fudickar et al. | 219/541 |
| 4,447,705 | 5/1984 | Bullock | 219/505 |
| 4,728,779 | 3/1988 | Kotani et al. | 219/505 |
| 4,814,584 | 3/1989 | Bohlender et al. | 219/505 |

FOREIGN PATENT DOCUMENTS

| | | |
|---|---|---|
| 2948593 | 12/1979 | Fed. Rep. of Germany . |
| 3042420 | 11/1980 | Fed. Rep. of Germany . |
| 3119302 | 5/1981 | Fed. Rep. of Germany . |
| 2580451 | 4/1985 | France . |
| 1034594 | 2/1964 | United Kingdom . |

*Primary Examiner*—A. D. Pellinen
*Assistant Examiner*—Jeffrey A. Gaffin
*Attorney, Agent, or Firm*—Ostrolenk, Faber, Gerb & Soffen

[57] ABSTRACT

A positive temperature coefficient thermistor device for use in a heating apparatus includes a board-type positive temperature coefficient thermistor element and a first and a second radiator for radiation disposed adjacent a front and a rear surface of the thermistor element, respectively. Each of the first and second radiators has a pair of fitting flanges which are respectively arranged on a pair of opposed sides of each radiator. Such fitting flanges are oriented with their longitudinal ends at right angles to a flow direction of air to be heated by the positive temperature coefficient thermistor device. Corresponding fitting flanges of the first and second radiators are engaged with each other by a pair of pin members which are inserted between respective pairs of opposing surfaces of the facing flanges to hold the flanges in a fixed relation to each other. The thermistor element is contained in a space surrounded by the first and second radiators.

9 Claims, 10 Drawing Sheets

9

9

9
9
9

POSITIVE TEMPERATURE COEFFICIENT THERMISTOR DEVICE FOR A HEATING APPARATUS

BACKGROUND OF THE INVENTION

1. Field of the Invention

The present invention relates to a positive temperature coefficient thermistor device for a heating apparatus comprising a positive temperature coefficient thermistor element to be used as a heating element and a radiator.

2. Description of Related Art

A heating apparatus used, for example, as a heater with a fan or an auxiliary heater for an air conditioner conventionally comprises a chrome-alloyed electric heating wire and a radiator for radiating heat generated from the wire. However, there are disadvantages with the use of such electric heating wire, particularly as regards safety; that is, abnormal overhearing heating may be caused by a failure of an electrical circuit. Accordingly, there has been developed for use in a heating apparatus a positive temperature coefficient thermistor device including a positive temperature coefficient (PTC) thermistor element as its heating element.

FIGS. 17 and 18 represent the structure of such positive temperature coefficient thermistor device for a heating apparatus. FIG. 17 is a front elevation view of the device and FIG. 18 is a side elevation view of the same. In these figures, a reference numeral 107 designates a disk-shaped PTC thermistor element and on both surfaces 170*a*, 170*a* of this element 107*a*, respective electrodes (not shown) are provided. Radiating plates 100, 103 are mounted respectively onto the two surfaces 107*a*, 107*a* of the element 107 so as to press against such surfaces. Radiating fins 102, 104 are attached to the radiating plates 100, 103, respectively, and air to be heated is fed through these radiating plate 100, 103 and radiating fins 102, 104, so as to provide heated air.

In addition to the foregoing structure, there have been developed other conventional positive coefficient thermistor devices for a heating apparatus, such as (i) a so-called harmonica-type device wherein a plurality of PTC thermistor elements are arranged in a ladder form between terminal plates, and air to be heated is fed through spaces between these elements; a device (ii) having PTC thermistor elements; with a honeycomb-shaped structure; and (ii) a device having a radiating plate with corrugated fins to which a PTC thermistor element is adhesively attached. However, in any of these conventional devices, the PTC thermistor elements are directly exposed to the air fed to the radiator, which comprises radiating plates and radiating fins. Therefore, there is the possibility of dust reaching the positive temperature coefficient thermistor devices and deteriorating the PTC thermistor elements. Where a PTC thermistor element and a radiator are assembled by a way of adhesive attachment, the mechanical strength of the device may totally decrease. Moreover, since the PTC thermistor elements are directly exposed to the air fed to the radiator as described above, the temperature variation between the windward side and the leeward side becomes great; thus, there are disadvantages of low heating efficiency and less generating power, caused by a so-called "pinch effect".

SUMMARY OF THE INVENTION

Accordingly, a first object of the present invention is to provide an improved positive temperature coefficient thermistor device for a heating apparatus which can overcome the above-noted so that the device may have high reliability and greater generating power.

Another object of the present invention is to provide a positive temperature coefficient thermistor device which can prevent dust from entering inside the positive temperature coefficient thermistor device so as to prevent the deterioration of a PTC thermistor element.

In accomplishing the first object, according to one preferred embodiment of the present invention, there is provided an improved positive temperature coefficient thermistor device for use in a heating apparatus which comprises a board-type positive temperature coefficient thermistor element, and a first and a second radiator for radiation disposed adjacent a front and a rear surface of the PTC thermistor element, respectively. of the first and second radiators has a pair of fitting flanges which are respectively arranged on a pair of opposed sides of each radiator so as to meet at right angles with the flow direction of the air to be heated by device. Corresponding fitting flanges of the first and second radiators are engaged with each other by means of respective urging means which are respectively inserted between the surfaces of the facing flanges to cause such flanges to be spaced in fixed relation to each other. The PTC thermistor element is beneficially contained in a space surrounded by the first and the second radiators.

Further, in accomplishing another object, according to a preferred embodiment of the invention, the device further comprises a frame member which is disposed between the first and the second radiators to position the thermistor element within the space. According to such structure, the PTC thermistor element accommodated between the radiators is not directly exposed to the air to be fed to the radiators. In other words, the flange part in each side of the radiator becomes like a screen so as to effectively shut out the air flow to the device. As a result, the phenomenon of "pinch effect" can be prevented.

Moreover, by accommodating the PTC thermistor element in the frame member, the PTC thermistor element can be stored in an enclosed space. The positioning of the thermistor element in the space is also easily carried out.

Advantages of various aspects of the present invention as described above are as follows:

(1) Owing to the screen-like part formed in the radiator, the phenomenon of "pinch effect" can be prevented and the radiation efficiency in the direction of the air flow is improved. Moreover, by increasing the area of a radiating section because of the flange part, the efficiency of heat transfer in the longitudinal direction of the radiator is improved, as well as improving the quantity of heat transfer in the direction orthogonal to the direction of air flow. Consequently, the distribution of temperature in the device is equalized as a whole.

(2) Since the radiator has longitudinal fitting flanges at both sides of the radiator, the mechanical strength of the device against a warp and flection in the direction orthogonal to with the air flow is improved.

(3) Since the air to be fed to the device does not flow into the device, turbulence can hardly occur when the air passes through the radiator, resulting in a highly efficient radiation effect can be achieved.

(4) Owing to the screen-like part provided for the radiator and the frame member surrounding the PTC thermistor element, there is no possibility of dust entering the device or of the direct exposure of the element to air. As a result, deterioration of the PTC thermistor element can be prevented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
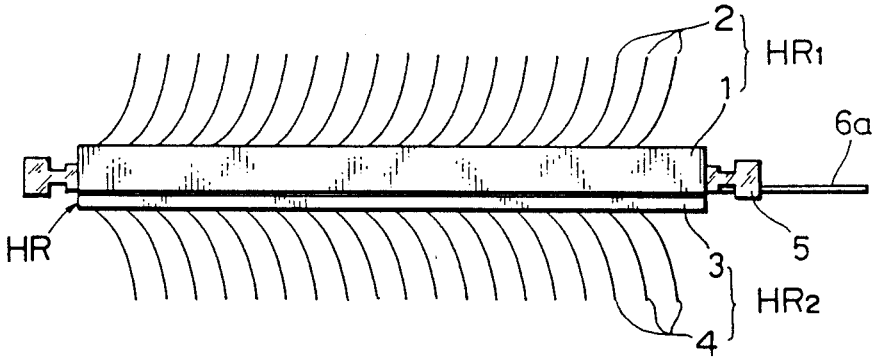
FIGS. 1 and 2 are, respectively, a front elevation view and an end view of a positive temperature coefficient thermistor device according to the first embodiment of the present invention.

Before the description of the present invention proceeds, it is to be noted that like parts are designated by like reference numerals and symbols throughout the several views of the accompanying drawings.

Figure 2:
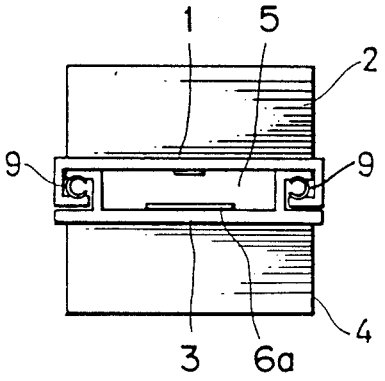
Figure 7:
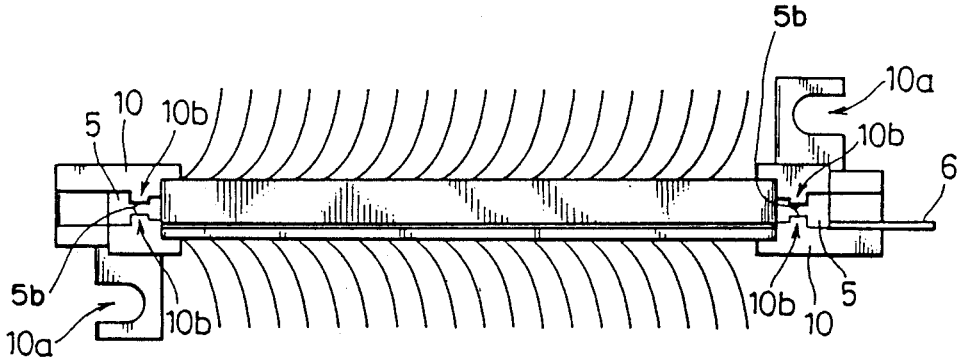
FIGS. 7 and 8 are, respectively, a front elevation view and a side elevation view illustrating a state wherein a holder is fitted in the device.

Referring now to FIGS. 7 and 2, there is shown a positive temperature coefficient thermistor device for use in a heating apparatus, according to a first embodiment of the invention. In these drawings, a reference symbol HR designates a radiator, and this radiator can be separated into two portions: a first radiator HR1 and a second radiator HR2. Each of the radiators HR1 and HR2 comprises a radiating plate 1, 3 and a plurality of radiating fins 2, 4, wherein the radiating plates 2, 4 are formed to be united with the radiating plates 1, 3. A positive temperature coefficient (PTC) thermistor element is incorporated in a space formed by the arrangement of these two radiating plates 1, 3. A reference numeral 5 designates a frame member made of an insulating material and functioning for positioning the PTC thermistor element in the radiator HR, amongst other function. A reference numeral **6*a* is an outside terminal part of a terminal plate 6 which comes in contact with one electrode of the PTC thermistor element. As shown in FIG. 2, flange parts, which will be described later, are arranged on both sides of each radiating plate 1, 3, and these flange parts are to be energized by respective pins 9,9, and to be united after being fitted to each other. These two spring pins 9,9** are cylindrical rod-type springs with a C-shaped section.

Figure 3:
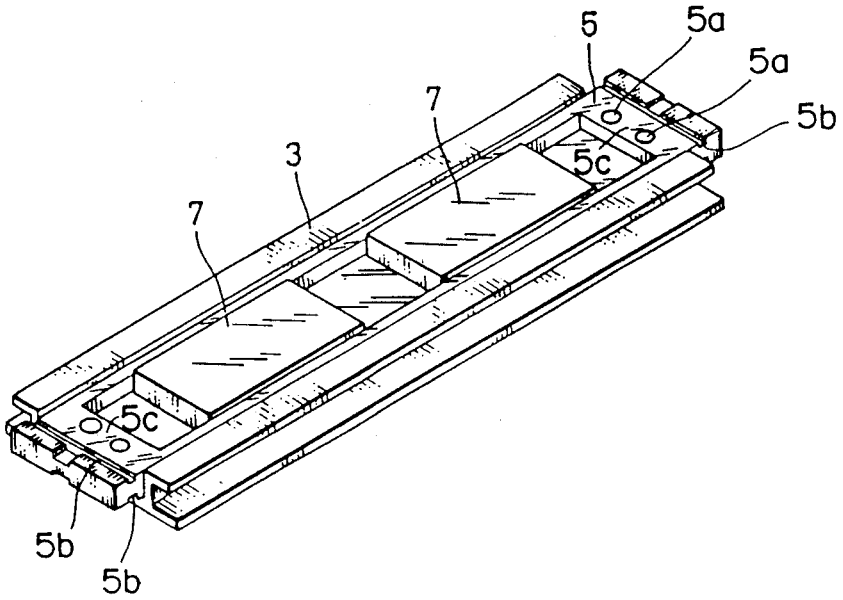
FIG. 3 is a perspective view illustrating the inner structure of the device of FIGS. 1 and 2.

FIG. 3 is a perspective view illustrating the inner structure of the device. In FIG. 3, a reference numeral 7 designates the board-type PTC thermistor element, as previously described, and side parts of the PTC thermistor element 7 are surrounded by a frame member 5 to provide a dustproof environment for the PTC thermistor element 7 and to facilitate electrical insulating and positioning of such element 7 used as shown in the FIG. 3.

Figure 4:
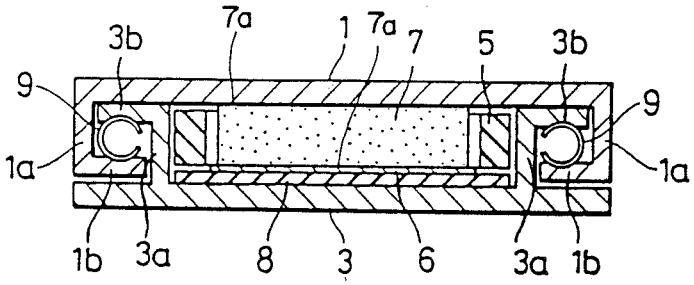
FIG. 4 is a sectional side elevation view illustrating the inner structure of the device of FIGS. 1 and 2.

In FIG. 4, reference numerals **1*a* and 1*b* designate fitting flanges formed on both sides of one radiating plate 1, and reference numerals 3*a* and 3*b* designate fitting flanges formed on both sides of another radiating plate 3. The pair of radiating plates 1, 3 is held together by means of two spring pins 9, 9. Thus, the inside space formed by the two radiating plates 1, 3 is enclosed by these flange parts of the radiating plates 1, 3 and by parts 5*c*, 5*c* (refer to FIG. 3) of the frame member 5. On the bottom of this space in ascending order, an insulation board 8, a terminal plate 6, and the PTC thermistor element 7 are layered in order, and the frame member 5 is disposed around the element 7 as shown in FIG. 3. On the front and rear surfaces 7*a*, 7*a* of the element 7, an electrode is formed. The electrode on the front surface of the PTC thermistor element 7 (on the upper side) is electrically connected to the radiating plate 1, and the electrode on its rear surface is electrically connected to the terminal plate 6, whereby electrical power can be supplied between the terminal plate 6 and the radiating plate 1**.

Figure 5:
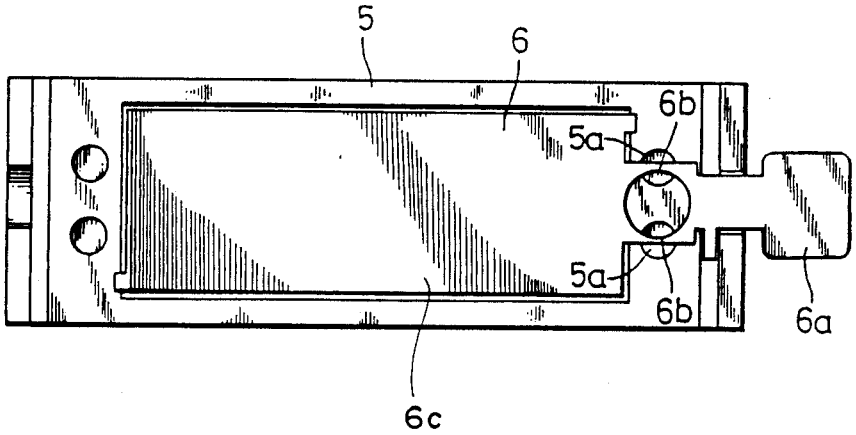
FIG. 5 is a plan elevation view illustrating a form of the terminal plate used in the first embodiment of the invention.

As shown in FIG. 5 the terminal plate 6 made of a metal plate comprises a body portion **6*c* with an approximately identical shape to the inside shape of the frame member 5, a outside terminal part 6*a* projecting from one shorter side of the frame member 5, and narrow-width parts 6*b*, 6*b* formed between the body portion 6*c* and the outside terminal part 6*a*. Due to the formation of the narrow-width parts 6*b*, the terminal plate 6 has a fuse function against an overcurrent condition. Several holes 5*a* are punched in the frame member 5 in order that the narrow-width parts 6*b* properly form fuse portions. The frame member 5** has a symmetric structure so that it can be used in any direction, such as upside down.

Figures 6, 6B, 6C:
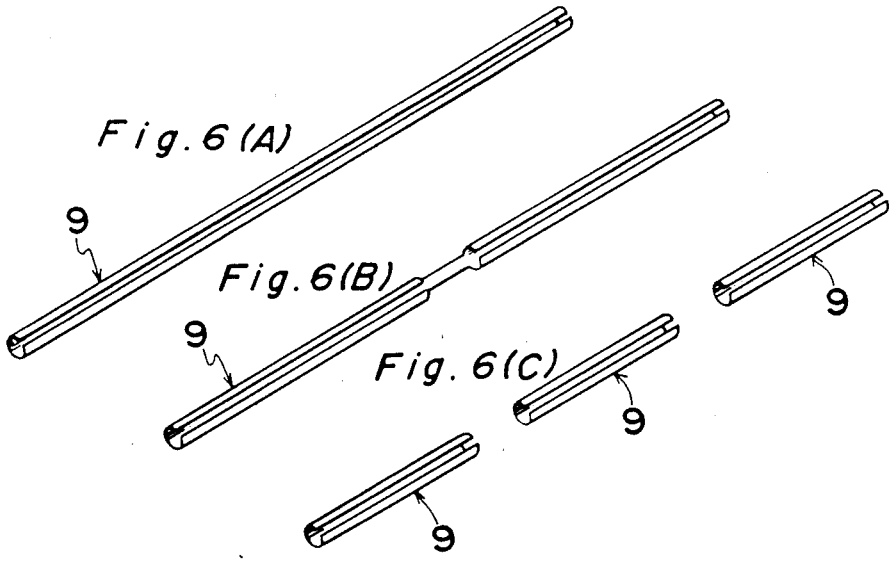
FIGS. 6 (A), (B) and (C) are perspective views of spring pins (as urging means ) in various forms, which can be applied to the first embodiment.

Referring now to FIGS. 6 (A)–(C), there are shown spring pins 9 with various forms, to be used at the time of fitting of the flange portions. As previously described, these spring pins 9 are made of a spring metal plate and formed to have a C-shaped section. With respect to the form of the spring pins 9, it is possible to use, in addition to an approximate cylinder-type pin shown in FIG. 6 (A), a type as shown in FIG. 6 (B)

comprising a plurality of independent spring pin parts (the parts having a C-shape section) formed on one or, a plurality of completely independent spring pins as shown in FIG. 6 (C) wherein a plurality of such spring pins are inserted into the flange part of one side.

When electricity is supplied to the PTC thermistor as shown for example, in FIG. 2, one one end of the spring pin 9 is made to be projected from the end part of the radiating plate, whereby such spring pin 9 can be used as a terminal of the radiating plate side. In this case, the radiating plate and the spring pin together engaged by means of elastic force, the insertion of the spring pin can be easily accomplished. In addition, since the flange part is located at a part of relatively lower heat conduction of the radiation section of the radiator HR, there is no possibility of heat caused deterioration of electrical properties on the contact surfaces of such spring-pin electrical terminal.

Figure 8:
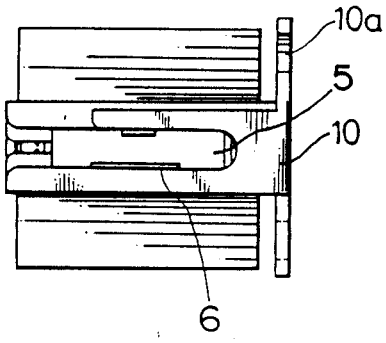

When a positive temperature coefficient thermistor device for a heating apparatus as described above is installed in a heating apparatus with a fan, for examples installation procedures are now described in connection with FIGS. 7 and 8. respectively, a front view and a side view illustrating a state wherein a pair of holders 10 is installed in the above-mentioned device. FIGS. 7–8, there are provided engagement parts 10*b*, 10*b* that are to be engaged with concave parts 5*b*, 5*b* formed on two sides of the frame member 5 and also the two holders 10 which hold respective ends of the frame member 5. In the holder 10, notches 10 are provided for use with mounting screws, whereby the device can be installed in a heating apparatus with a fan positioned in parallel to the retaining faces containing the notches 10*a* and being at right angles to the direction of air flow. When the holder 10 is made of electric- and heat-insulating material, the electric insulation and heat resistance between the heating apparatus and the device can be maintained.

Figure 9:
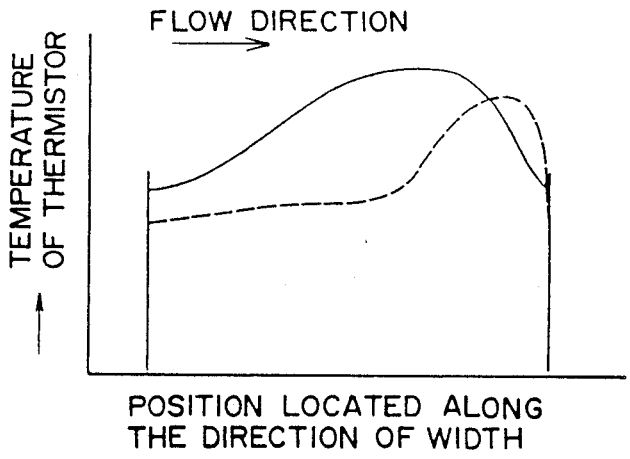
FIGS. 9 (A) and (B) are graphs showing the distribution of temperature of the positive temperature coefficient thermistor element in the device.
Figure 9:
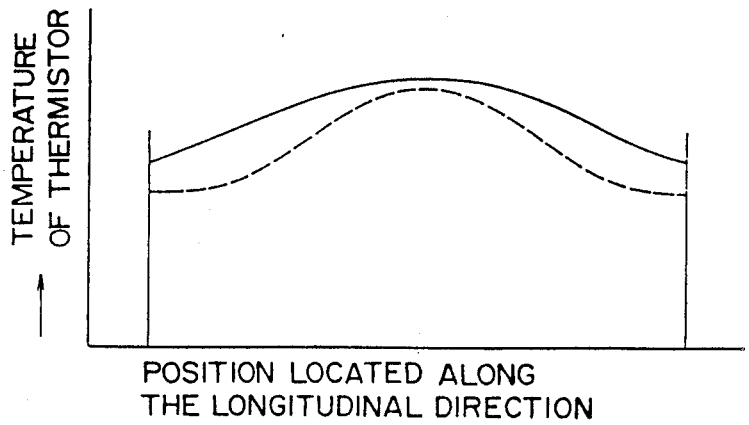

The distribution of temperature of the PTC thermistor element 7 in the positive temperature coefficient thermistor device described above is shown in FIGS. 9 (A) and 9(B). FIG. 9 (A) shows the distribution of temperature in the lateral direction (the direction of air flow) of the element, and FIG. 9 (B) shows the distribution of temperature in the longitudinal direction (the direction crossing the direction of air flow at right angles) of the element. A solid line in the drawing designates the distribution of temperature of the PTC thermistor element according to the above-mentioned embodiment, and a broken line designates the distribution of temperature of the element in a conventional device for a heating apparatus, for comparison. Since the flange part is formed at each side of the radiator HR, the thermal capacity of the whole radiator increases, and the temperature of the thermistor elements, that contributes to heat conduction rises in general as shown in FIG. 9 (A). Moreover, since the element is not directly exposed to cold air, due to the flange part, the peak of heating temperature of the element is centralized and widened, which means heat generation from the whole element, leading to improvement of heating efficiency. This improvement of heating efficiency is related to the distribution of the electric resistance value of the thermistor element itself. For example, when the element is directly exposed to air under the condition that a certain current flows in the direction of thickness of the element at the windward side, the element is refrigerated, and therefore, the resistance value of the element around such area lowers, leading to low heating temperature.

On the other hand, at the leeward side, the element is relatively less refrigerated, so that a high resistance value is maintained, leading to high heating temperature. As a result, an area of maximum heating area moves to the leeward side, and the overall area of heating is reduced. However, when the element is not directly exposed to the air, as described in this embodiment, a heating area is evenly extended in the whole element having a central part of the element as its peak, and the area of heating becomes wider. This, consequently, contributes to the relative increase of thermal capacity. Moreover, since the section area taken along the longitudinal direction of the radiator HR increases due to the flange parts on the radiating plates, heat from the element 7 can be fully conducted not only to the radiating fins right above and below the element but also to the other part of the radiating fins. Additionally, to the above, as shown in FIG. 9 (B), the distribution of temperature is also evened out in the longitudinal direction of the element, thus resulting in improved radiation efficiency.

Figure 10:
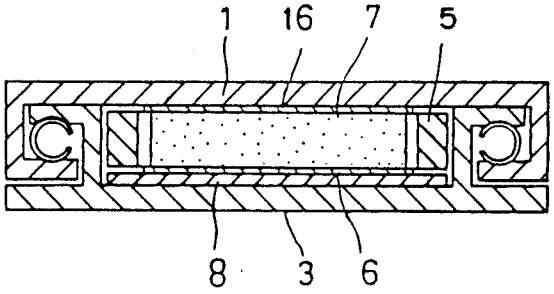
FIGS. 10 and 11 are sectional side elevation views showing the structure of the positive temperature coefficient thermistor device according to a second and third embodiment of the present invention, respectively.
Figure 11:
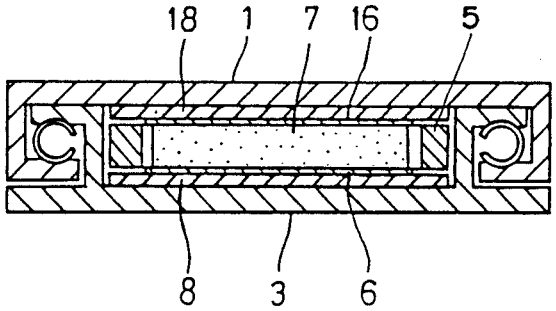

In the first embodiment (e.g. FIG. 4), one electrode of the PTC thermistor element 7 is connected to the terminal plate 6, and another electrode is directly connected to the radiating plate. However, as shown in FIGS. 10 and 11, which respectively illustrates second and third embodiments, two terminal plates 6, 16 can be arranged in the device. FIG. 10, one terminal plate 6 is electrically insulated from the radiating plate 3 by means of the insulating board 8, while the other terminal plate 16 is directly arranged between the element and the radiating plate 1. Accordingly, in this structure, there is a distinctive feature that materials of high electrical reliability can be freely selected as a material for the terminal plate, regardless of the material used for the radiating plates; that is, by using terminal 16 exclusively to supply power.

In the third embodiment of the invention shown in FIG. 11, both of terminal plates 6, 16 are electrically insulated from the radiating plates by means of insulating boards 8, 18. In this embodiment an electric shock and leakage can be prevented.

Figure 12:
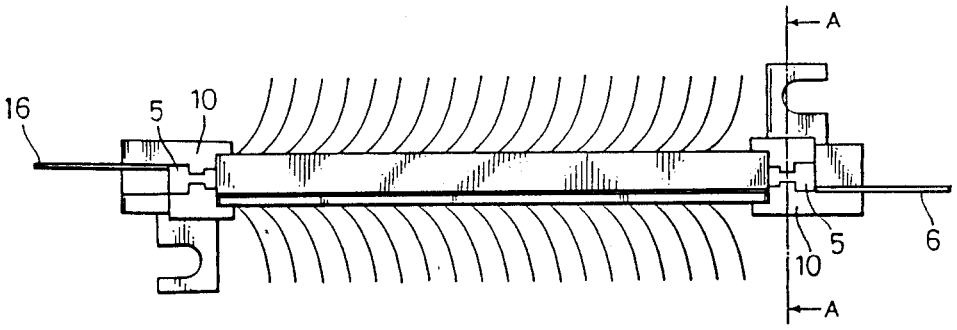
FIGS. 12 and 13 are, respectively, a front elevation view and a side elevation view illustrating a state wherein a holder is attached to the device according to either the second or the third embodiment.
Figure 13:
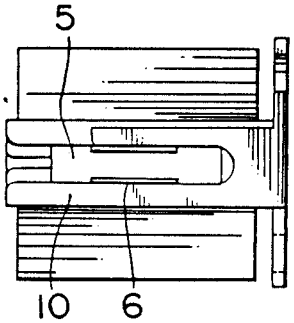
Figure 14:
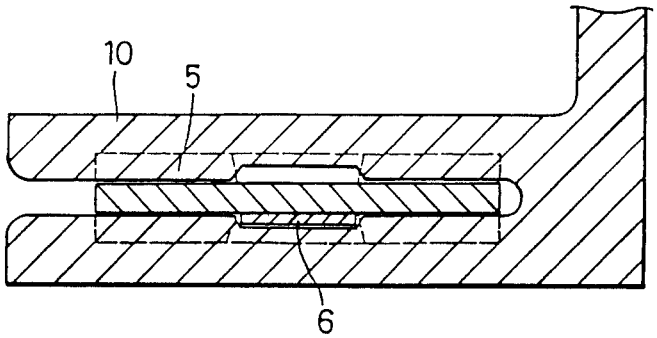
FIG. 14 is a section view taken substantially on line A—A of FIG. 12.

FIGS. 12–14 illustrate a state wherein a holder is attached to the above-mentioned positive temperature coefficient thermistor device having two terminal plates 6, 16. FIGS. 12 and 13 are a front view and a side view of the device having the holder 10, respectively, and FIG. 14 is a section view taken substantially on line A—A of FIG. 12. As shown in FIG. 14, the terminal plates 6, 16 are pressed against by an engagement part of the holder 10, 10 and the frame member 5 so as to be fixed as previously described. With the holders 10 being engaged with both end parts of the frame member 5, the positioning and fixing of the terminal plates 6, 16 are carried out simultaneously with the fixation of the holders 10, 10 to the frame member 5.

Figure 15:
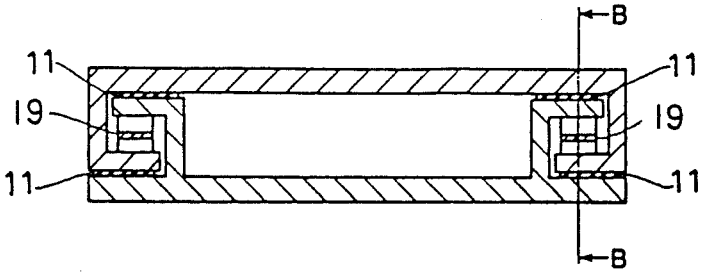
FIG. 15 is a section view illustrating a structure of the radiator using a leaf spring instead of a spring pin.
Figure 16:
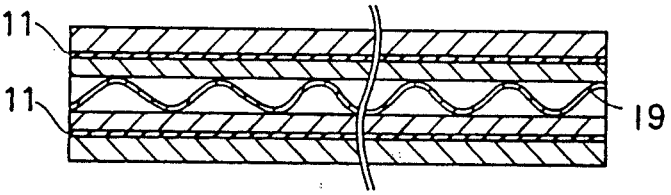
FIG. 16 is a section view taken substantially on line B—B of FIG. 15.
Figure 17:
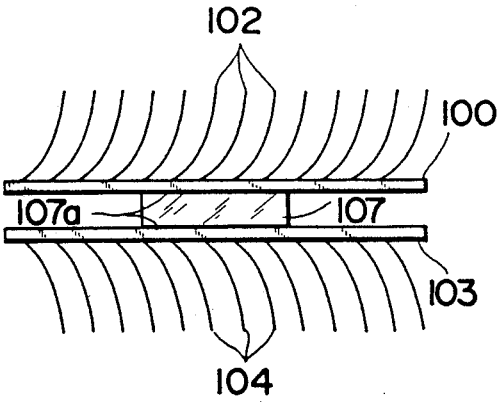
Fig. 17 PRIOR ART
FIGS. 17 and 18 are, respectively, a front view and a side view illustrating the schematic structure of a conventional type PTC thermistor device, as previously described.
Figure 18:
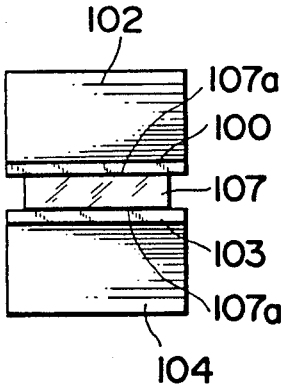
Fig. 18 PRIOR ART

In any of the above-mentioned embodiments, the spring pin 9 is inserted between the fitting flanges formed on both sides of two radiating plates; however, the structure shown in FIGS. 15 and 16 is also applicable. A reference numeral 19 designates a metal leaf spring with a corrugated shape, and a reference numeral 11 designates an elastic element such as a rubber sheet and a room-temperature-hardening-type resin sheet. Such formation of the elastic element also effectively prevents dust and moisture from entering through the side parts of the device.

Although the present invention has been fully described by way of example with reference to the accompanying drawings, it is to be noted here that various changes and modifications will be apparent to those skilled in the art. For example, the above-mentioned device can be used as a device for current control without any change. Therefore, unless otherwise such changes and modifications depart from the scope of the present invention as defined in the appended claims, they should be construed as included therein.

What is claimed is:

1. A positive temperature coefficient thermistor device for use in a heating apparatus, which device comprises a board-type positive temperature coefficient thermistor element and a first and a second multi-finned radiator for radiation disposed adjacent a front and a rear surface of said thermistor element, respectively;

each of said first and second radiators having a pair of fitting flanges which are respectively arranged on a pair of opposed sides of said each radiator and which have longitudinal ends oriented to meet transverse to the flow direction of air to be heated by said positive temperature coefficient thermistor device;

corresponding fitting flanges of said first and second radiators being engaged with each other by means of respective resilient urging means which are inserted between respective pairs of opposing surfaces of the facing flanges to hold said facing flanges in fixed relation to each other; and said thermistor element being contained in a space surrounded by said first and second radiators.

2. A positive temperature coefficient thermistor device as set forth in claim 1, wherein said urging means comprising an elongated corrugated sheet-type spring member.

3. A positive temperature coefficient thermistor device as set forth in claim 1, wherein:

each of said first and second radiators comprises a radiating plate having said fitting flanges on a pair of the opposed sides thereof; and a plurality of radiating fins formed on the outer surface of said radiating plate;

said radiating fins being formed to be integrated with said radiating plate by cutting and raising a part of said radiating plate.

4. A positive temperature coefficient thermistor device for use in a heating apparatus, which device comprises a board-type positive temperature coefficient thermistor element and a first and a second radiator for radiation disposed adjacent a front and a rear surface of said thermistor element, respectively;

each of said first and second radiators having a pair of fitting flanges which are respectively arranged on a pair of opposed sides of said each radiator and which have longitudinal ends oriented to meet transverse to the flow direction of air to be heated by said positive temperature coefficient thermistor device;

corresponding fitting flanges of said first and second radiators being engaged with each other by means of respective urging means which are inserted between respective pairs of opposing surfaces of the facing flanges to hold said facing flanges in fixed relation to each other;

said urging means comprising a pin member cylindrically formed of a material of a sheet spring and having a C-shaped section; and said thermistor element being contained in a space surrounded by said first and second radiators.

5. A positive temperature coefficient thermistor device for use in a heating apparatus, which device comprises a board-type positive temperature coefficient thermistor element and a first and a second radiator for radiation disposed adjacent a front and a rear surface of said thermistor element, respectively;

each of said first and second radiators having a pair of fitting flanges which are respectively arranged on a pair of opposed sides of said each radiator and which are longitudinal ends oriented to meet transverse to the flow direction of air to be heated by said positive temperature coefficient thermistor device:

corresponding fitting flanges of said first and second radiators being engaged with each other by means of respective urging means which are inserted between respective pairs of opposing surfaces of the facing flanges to hold said facing flanges in fixed relation to each other;

said thermistor element being contained in a space surrounded by said first and second radiators; and the device further comprising a frame member which is disposed between said first and second radiators to position said thermistor element within said space.

6. A positive temperature coefficient thermistor device as set forth in claim 5 further comprising a pair of holders each of which integratedly clamps ends of said first and second radiators and said frame member.

7. A positive temperature coefficient thermistor device as set forth in claim 5 further comprising a thermal plate disposed at, at least, one space between said thermistor element and said first and second radiators.

8. A positive temperature coefficient thermistor device as set forth in claim 7, wherein said thermal plate comprises a body portion, an outside thermal part, and a narrow-width part for connecting these two parts.

9. A positive temperature coefficient thermistor device as set forth in claim 7, further comprising an insulating board disposed between said thermal plate and the corresponding radiator.

* * * * *